US011454103B2

(12) United States Patent
Hepburn et al.

(10) Patent No.: US 11,454,103 B2
(45) Date of Patent: Sep. 27, 2022

(54) METHOD, SYSTEM, AND MEDIUM FOR CONTROLLING RATE OF A PENETRATION OF A DRILL BIT

(71) Applicant: Pason Systems Corp., Calgary (CA)

(72) Inventors: Quinn Harrison Hepburn, Calgary (CA); Trevor Leigh Holt, Calgary (CA)

(73) Assignee: PASON SYSTEMS CORP.

( * ) Notice: Subject to any disclaimer, the term of this patent is extended or adjusted under 35 U.S.C. 154(b) by 0 days.

(21) Appl. No.: 16/156,143

(22) Filed: Oct. 10, 2018

(65) Prior Publication Data

US 2019/0353022 A1 Nov. 21, 2019

(30) Foreign Application Priority Data

May 18, 2018 (CA) ..... CA 3005535

(51) Int. Cl.
*E21B 44/00* (2006.01)
*E21B 19/00* (2006.01)
*E21B 19/04* (2006.01)

(52) U.S. Cl.
CPC ..... *E21B 44/00* (2013.01); *E21B 19/008* (2013.01); *E21B 19/04* (2013.01)

(58) Field of Classification Search
None
See application file for complete search history.

(56) References Cited

U.S. PATENT DOCUMENTS

| | | | | |
|---|---|---|---|---|
| 3,029,951 | A | 4/1962 | Cannon | |
| 3,265,359 | A | 8/1966 | Bowden | |
| 3,777,560 | A | 12/1973 | Guignard | |
| 3,815,673 | A | 6/1974 | Bruce | |
| 3,842,347 | A | 10/1974 | Terbrack | |
| 3,881,695 | A | 5/1975 | Joubert | |
| 3,931,735 | A | 1/1976 | Guigmard | |
| 4,128,888 | A * | 12/1978 | Sheldon | E21B 19/20 340/670 |

(Continued)

FOREIGN PATENT DOCUMENTS

CA 2536945 A1 8/2017

OTHER PUBLICATIONS

"Automatic Driller" Pason Systems, Jun. 27, 2015, retrieved from the internet at <http://web.archive.org/web/20150629075217/http://www.pason.com:80/rigsite/automaticdriller> on May 9, 2017.

(Continued)

*Primary Examiner* — Mohammad Ali
*Assistant Examiner* — David Earl Ogg
(74) *Attorney, Agent, or Firm* — Katten Muchin Rosenman LLP

(57) ABSTRACT

Methods, systems, and techniques for controlling the rate of penetration of a drill bit are described. In particular, an operate control loop is evaluated by: determining a travelling block acceleration of a travelling block; determining an acceleration error measurement between the travelling block acceleration and a target travelling block acceleration; determining, based on the acceleration error measurement, a brake control signal; and using the brake control signal to control a braking mechanism configured to apply a variable braking force to the travelling block.

19 Claims, 13 Drawing Sheets

(56) References Cited

U.S. PATENT DOCUMENTS 4,187,546 A * 2/1980 Heffernan ..... E21B 19/20 173/2
4,354,233 A 10/1982 Zhukovsky
4,545,017 A * 10/1985 Richardson ..... E21B 19/00 254/276
4,662,608 A 5/1987 Ball
4,843,875 A 7/1989 Kerbart
5,474,142 A 12/1995 Bowden
5,713,422 A 2/1998 Dhindsa
5,842,149 A 11/1998 Harrell
5,927,408 A 7/1999 Dummer
6,021,377 A 2/2000 Dubinsky
6,026,912 A 2/2000 King et al.
6,029,951 A * 2/2000 Guggari ..... B66D 1/485 173/11
6,152,246 A 11/2000 King et al.
6,206,108 B1 3/2001 MacDonald
6,293,356 B1 9/2001 King et al.
6,382,331 B1 5/2002 Pinckard
6,402,259 B2 * 6/2002 Corio ..... B60T 8/1703 244/111
6,460,943 B1 * 10/2002 Toepfer ..... B60T 8/00 303/113.4
6,944,547 B2 9/2005 Womer et al.
6,994,172 B2 2/2006 Ray
7,095,427 B2 8/2006 Goto
7,100,708 B2 9/2006 Koederitz
7,537,066 B1 5/2009 Flud et al.
7,775,297 B2 8/2010 Hopwood et al.
7,857,075 B2 12/2010 Jeffryes
8,136,609 B2 3/2012 Hopwood et al.
8,256,534 B2 9/2012 Byreddy et al.
8,274,399 B2 9/2012 Strachan et al.
8,453,764 B2 6/2013 Turner et al.
8,527,249 B2 9/2013 Jamison et al.
8,602,126 B2 12/2013 Boone et al.
8,636,086 B2 1/2014 Hbaieb
8,843,220 B1 9/2014 Rembach et al.
2003/0184155 A1 * 10/2003 Crombez ..... B60L 50/52 303/152
2008/0135290 A1 6/2008 Hopwood
2009/0090555 A1 * 4/2009 Boone ..... E21B 44/02 175/45
2010/0300753 A1 12/2010 Hopwood
2011/0174538 A1 * 7/2011 Chan ..... E21B 19/08 175/24
2015/0053482 A1 2/2015 Boone
2015/0252664 A1 9/2015 Astrid
2015/0308253 A1 10/2015 Clark et al.
2015/0369031 A1 12/2015 Yang et al.
2016/0024905 A1 1/2016 Johnson et al.
2016/0047219 A1 2/2016 Jeffryes
2016/0053603 A1 2/2016 Israel et al.
2016/0053604 A1 2/2016 Abbassian et al.

OTHER PUBLICATIONS

Office Action for Canadian Patent Application No. 2,930,320 dated Feb. 26, 2019, 5 sheets.
Non-Final Rejection dated Apr. 18, 2019, from U.S. Appl. No. 15/592,562, 79 sheets.
Notice of Allowance dated Nov. 5, 2019, from U.S. Appl. No. 15/592,562, 65 sheets.

* cited by examiner

1020

1010

METHOD, SYSTEM, AND MEDIUM FOR CONTROLLING RATE OF A PENETRATION OF A DRILL BIT

TECHNICAL FIELD

The present disclosure is directed at methods, systems, and techniques for controlling rate of penetration of a drill bit.

BACKGROUND

During oil and gas drilling, a drill bit located at the end of a drill string is rotated into and through a formation to drill a well. The rate of penetration of the drill bit through the formation reflects how quickly the well is being drilled. Generally, it is unadvisable to blindly increase drilling parameters such as weight-on-bit or drill string torque in an attempt to increase the rate of penetration; doing so may cause the drilling process to catastrophically fail.

To safely and efficiently drill wells, an automatic driller may be used. Automatic drillers attempt to control the rate of penetration of the drill bit by taking into account one or more drilling parameters.

SUMMARY

In a first aspect of the disclosure, there is provided a method for controlling rate of penetration of a drill bit. The method comprises evaluating an operate control loop by determining a travelling block acceleration of a travelling block. The operate control loop is further evaluated by determining an acceleration error measurement between the travelling block acceleration and a target travelling block acceleration, and determining, based on the acceleration error measurement, a brake control signal. The brake control signal is used to control a braking mechanism configured to apply a variable braking force to the travelling block.

The operate control loop may be further evaluated by reading a travelling block velocity of the travelling block, determining, based on the travelling block velocity, a velocity error measurement between the travelling block velocity and a travelling block velocity setpoint, and determining, based on the velocity error measurement, the target travelling block acceleration.

The braking mechanism may be configured to operate within an operating range defined by a lower braking force limit at which the braking mechanism applies a lower braking force, and an upper braking force limit at which the braking mechanism applies an upper braking force greater than the lower braking force.

Prior to reading the travelling block acceleration, a pause control loop may be evaluated by determining that an amount of movement of the travelling block is less than a preset minimum amount of movement, subsequently determining that an amount of movement of the travelling block is greater than the preset minimum amount of movement, and, in response thereto, preventing, for a predetermined period of time, reduction in the braking force applied to the travelling block. Determining that an amount of movement of the travelling block is less than a preset minimum amount of movement may comprise determining that the travelling block has stopped moving.

Prior to reading the travelling block acceleration, a seek operation may be performed by controlling the braking mechanism so as to reduce the variable braking force, and detecting a minimum amount of movement of the travelling block. In some embodiments, the minimum amount of movement comprises a minimum displacement of the travelling block. Subsequent to detecting the minimum amount of movement, a retract operation may be performed by further controlling the braking mechanism so as to increase the variable braking force, and detecting that an amount of movement of the travelling block is less than a maximum amount of movement. In some embodiments, the maximum amount of movement comprises a maximum acceleration of the travelling block. In both the seek and the retract operations, the minimum amount of movement may comprise a displacement of the travelling block, a velocity of the travelling block, or an acceleration of the travelling block.

Controlling the braking mechanism so as to reduce the variable braking force may comprise transitioning the braking mechanism from a maximum braking force limit, at which the braking mechanism applies a maximum braking force, to a first braking force limit at which the braking mechanism applies a first braking force. Controlling the braking mechanism so as to increase the variable braking force may comprise transitioning the braking mechanism from the first braking force limit to a second braking force limit at which the braking mechanism applies a second braking force greater than the first braking force and less than the maximum braking force. The first braking force limit may correspond to the lower braking force limit, and the second braking force limit may correspond to the upper braking force limit.

The lower braking force limit and the upper braking force limit may be functions of the acceleration error measurement.

The brake control signal may identify a target braking force, and the target braking force may be a function of the acceleration error measurement and at least one of the lower braking force limit and the upper braking force limit. A current braking force or the target braking force may be determined to be less by a predetermined amount than the braking force applied to the travelling block immediately before the seek operation was evaluated, and in response thereto, the braking force may be increased for a predetermined period of time.

The operate control loop may be further evaluated by determining that a current braking force applied by the braking mechanism is lower than the lower braking force limit or greater than the upper braking force limit, and, in response thereto, respectively the lower braking force limit may be reduced and the upper braking force limit may be increased, or the upper braking force limit may be increased and the lower braking force limit may be reduced.

The operate control loop may be further evaluated by preventing the upper braking force limit from being reduced if it is determined that an amount of movement of the travelling block is less than a preset amount of movement of the travelling block. The preset amount of movement may be nil movement.

The operate control loop may be further evaluated by determining that a current braking force applied by the braking mechanism is between the lower braking force limit and the upper braking force limit, and, in response thereto, decreasing the operating range by performing one or more of: increasing the lower braking force limit; and decreasing the upper braking force limit.

The operate control loop may be further evaluated by controlling the braking mechanism so as to prevent reduction of the variable braking force in response to determining one or more of: a differential pressure reading being greater than a differential pressure setpoint plus an offset; a weight-on-bit reading being greater than a weight-on-bit setpoint plus an offset; and a torque reading being greater than a torque setpoint plus an offset. The offset may be a nil offset.

Controlling the variable braking force may comprise controlling a rate at which the variable braking force is adjusted as a function of the current braking force applied by the braking mechanism.

The braking mechanism may be movable to apply the variable braking force, and controlling the variable braking force may comprise controlling a rate at which the braking mechanism moves.

Controlling the variable braking force may comprise decreasing a rate at which the variable braking force is adjusted if it is determined that the current braking force is being decreased, and increasing a rate at which the variable braking force is applied if it is determined that the current braking force is being increased.

The operate control loop may be further evaluated by, in response to determining that a travelling block velocity of the travelling block is greater than a first preset maximum velocity, controlling the braking mechanism so as to increase the braking force applied to the travelling block until the travelling block velocity is less than a second preset maximum velocity. The first preset maximum velocity may be a velocity setpoint plus an offset, and the second preset maximum velocity may be the velocity setpoint minus an offset. The offsets may be nil offsets. Controlling the braking mechanism may comprise increasing the braking force applied to the travelling block at a maximum rate.

The braking mechanism may comprise a band brake or a disc brake.

Controlling the braking mechanism may comprise outputting a control signal for adjusting the variable braking force. In some embodiments, the control signal may be configured to adjust a position of a brake handle operably connected to the braking mechanism. In some embodiments, the control signal may control for example a disc brake, or a hydraulic ram that controls a band brake.

Prior to evaluating the operate control loop, for each of multiple drilling parameters, a control loop may be evaluated by reading a drilling parameter measurement, determining an error measurement that represents a difference between a drilling parameter setpoint and the drilling parameter measurement, determining, from the error measurement, an output signal proportional to the rate of penetration of the drill bit, and selecting the output signal of one of the control loops. The output signal that is selected may be used to determine the travelling block velocity setpoint.

In a further aspect of the disclosure, there is provided a system for controlling rate of penetration of a drill bit. The system comprises a braking mechanism configured to apply a variable braking force to a travelling block, a processor, and a computer-readable medium communicatively coupled to the processor and having stored thereon computer program code configured when executed by the processor to cause the processor to perform a method. The method comprises evaluating an operate control loop by determining a travelling block acceleration of the travelling block, determining an acceleration error measurement between the travelling block acceleration and a target travelling block acceleration, determining, based on the acceleration error measurement, a brake control signal, and using the brake control signal to control the braking mechanism.

The system may comprise any of the features described above in connection with the first aspect of the disclosure.

In a further aspect of the disclosure, there is provided a computer-readable medium communicatively coupled to a processor and having stored thereon computer program code configured when executed by the processor to cause the processor to perform any of the above-described methods.

This summary does not necessarily describe the entire scope of all aspects. Other aspects, features and advantages will be apparent to those of ordinary skill in the art upon review of the following description of specific embodiments.

BRIEF DESCRIPTION OF THE DRAWINGS

In the accompanying drawings, which illustrate one or more example embodiments.

DETAILED DESCRIPTION

The present disclosure seeks to provide an improved methods and systems for controlling rate of penetration of a drill bit. While various embodiments of the disclosure are described below, the disclosure is not limited to these embodiments, and variations of these embodiments may well fall within the scope of the disclosure which is to be limited only by the appended claims.

During well drilling, multiple sensors may be used to monitor various drilling parameters, such as weight-on-bit ("WOB"), torque applied to the drill string, and differential pressure. Those sensors may be communicative with an automatic driller that uses those sensor measurements to control the rate of penetration of the drill bit. Generally, the embodiments described herein are directed at methods, systems, and techniques to control the rate of penetration of the drill bit by controlling a braking mechanism, such as a band brake, configured to apply a variable braking force to a travelling block of the drill rig. The travelling block is connected to the drill string, and therefore controlling a velocity of the travelling block is equivalent to controlling rate of penetration (ROP) of the drill bit.

The automatic driller seeks to control the velocity of the travelling block by using acceleration of the travelling block as a controlling parameter. In particular, the automatic driller reads a current acceleration of the travelling block, and, based on a difference between the current acceleration and a target acceleration, determines a control signal for controlling the braking mechanism. The target acceleration may be a function of a current velocity of the travelling block. By controlling the braking mechanism so that the velocity of the travelling block is maintained close to a target velocity, the automatic driller may leverage the dynamic range of the braking mechanism, and smoother control over the travelling block's velocity may be achieved.

Figure 1:
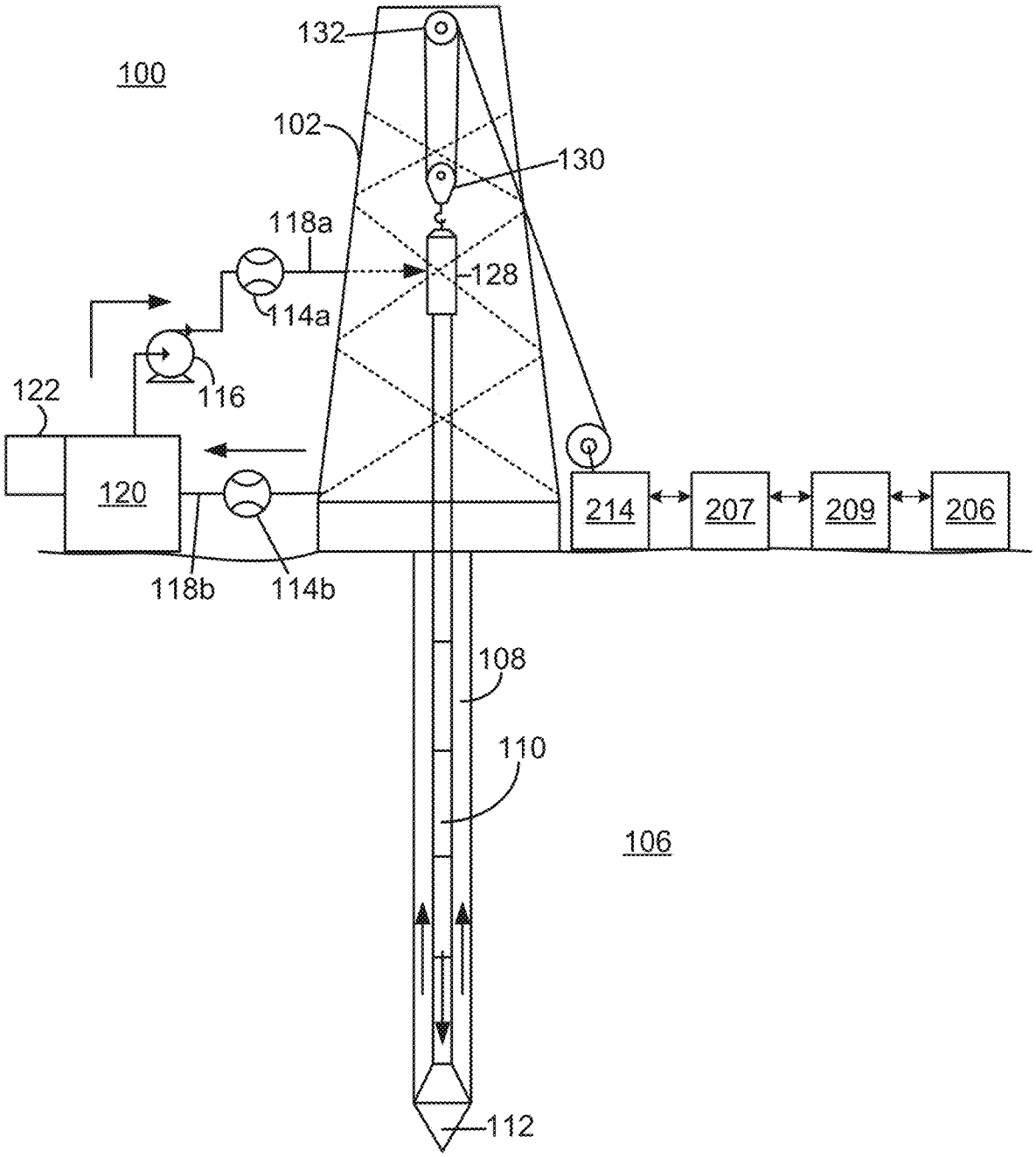
FIG. 1 depicts an oil rig that is being used to drill a well in conjunction with an automatic driller, according to one example embodiment.

Referring now to FIG. 1, there is shown an oil rig that is being used to drill a well in conjunction with an automatic driller 206, which comprises part of an example system for controlling the rate of penetration of a drill bit. The rig comprises a derrick 102 from which downwardly extends into a formation 106 a drill string 110 at the end of which is a drill bit 112. Mounted to the derrick 102 are a crown block 132 and a travelling block 130 that is movable by means of a pulley system relative to the crown block 132. A top drive 128 is attached to the bottom of the travelling block 130 via a hook and connects the travelling block 130 to the drill string 110. The top drive 128 provides the torque and consequent rotary force used to rotate the drill string 110 through the formation 106. A drawworks 214 is at the base of the rig and comprises a pulley system that connects the drawworks 214 to the crown block 132 and that enables the drawworks 214 to vertically translate the travelling block 128 relative to the crown block 132. A band brake 207 is operably coupled to drawworks 214 and is configured to apply a variable braking force to the drum of drawworks 214, thereby applying the same variable braking force to travelling block 130. Automatic driller 206 is operably coupled to a stepper motor 209 which controls a brake handle of band brake 207. Automatic driller 206 is configured to output a control signal to stepper motor 209 which in turn adjusts a position of the brake handle as a function of the control signal. Varying the position of the brake handle correspondingly adjusts the variable force applied by band brake 207. Therefore, automatic driller 206 controls, via stepper motor 209, the degree to which band brake 207 applies a braking force to travelling block 130. While the drill string 110 in the depicted embodiment is rotatably powered by the top drive 128, in different embodiments (not depicted) the top drive 128 may be replaced with a swivel, rotary table and kelly. Rotation of the drill bit 112 through the formation 106 drills a well 108.

A reservoir 120 for drilling fluid (hereinafter interchangeably referred to as a "mud tank 120" or "mud pit 120") stores drilling fluid for pumping into the well 108 via the drill string 110. A volume meter 122 is affixed to the mud tank 120 and is used to measure the total volume of the drilling fluid stored in the mud tank 120 at any particular time (this volume is hereinafter interchangeably referred to as "pit volume"). A closed fluid circuit comprises the mud tank 120, a fluid input line 118*a* for sending the drilling fluid down the interior of the drill string 110 via the top drive 128 and subsequently into the annulus between the drill string 110 and the annular surface of the well 108, and a fluid return line 118*b* for returning the drilling fluid from that annulus to the mud tank 120; the direction of drilling fluid flow along this closed fluid circuit is shown by arrows in FIG. 1. A mud pump 116 is fluidly coupled to and located along the fluid input line 118*a* and is used to pump the drilling fluid from the mud tank 120 into the drill string 110. An input flow meter 114*a* and a return flow meter 114*b* are fluidly coupled to and located along the fluid input line 118*a* and fluid return line 118*b*, respectively, and are used to monitor flow rates into and out of the well 108. A driller's cabin and doghouse are not shown in FIG. 1, but in certain embodiments are also present at the rigsite and are discussed in respect of FIG. 2, below.

As used herein, the rate of penetration of the drill string 110, the drum speed of the drawworks 214, and the velocity of the travelling block 130 are all directly proportional to each other and are effectively used interchangeably for simplicity.

The rig also comprises various sensors (depicted in FIG. 2), such as a hookload sensor 222, standpipe pressure sensor 220, torque sensor 218, and block height sensor 216, as discussed in more detail below. As discussed in further detail below, sensor readings are sent to the automatic driller 206 and are used to facilitate control of the rate of penetration of the drill bit 112 by the automatic driller 206.

Figure 2:
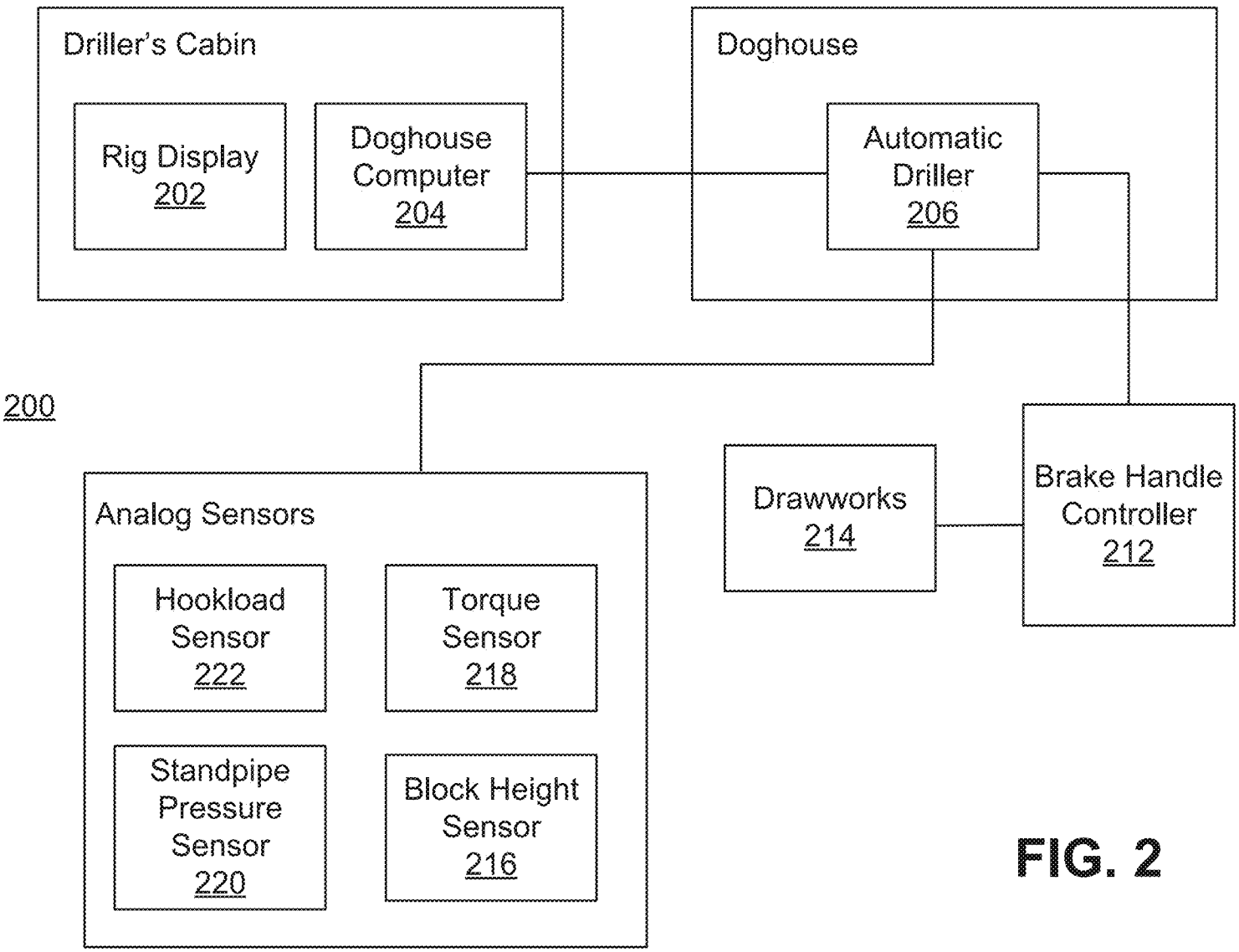
FIG. 2 depicts a block diagram of an embodiment of a system for controlling the rate of penetration of a drill bit and that comprises the automatic driller of FIG. 1.
Figure 3:
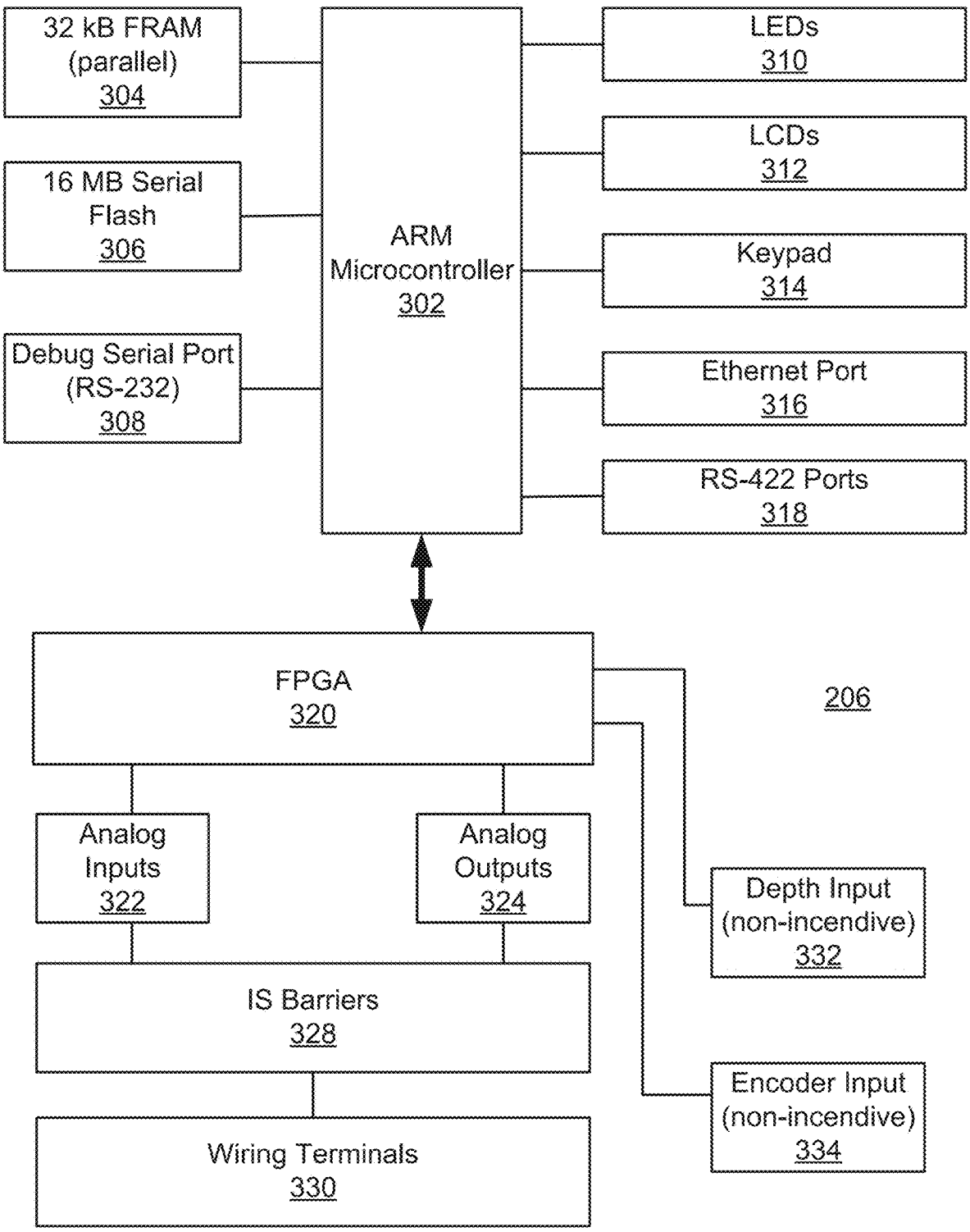
FIG. 3 depicts a block diagram of the automatic driller of FIG. 1.

Referring now to FIG. 2, there is shown a hardware block diagram 200 of the embodiment of the system 100 of FIG. 1. An automatic driller 206, which is shown in more detail in FIG. 3, is present in the doghouse and is configured to perform a method for controlling the rate of penetration of a drill bit, as described in more detail below. An example automatic driller that may be modified to perform the method is the Automatic Driller™ offered by Pason Systems Corp.™ The automatic driller 206 is communicatively coupled to a doghouse computer 204 and a rig display 202 in a driller's cabin; the doghouse computer 204 and rig display 202 each permit a driller to interface with the automatic driller 206 by, for example, setting drilling parameter setpoints and obtaining drilling parameter measurements. The rig display 202 may be, for example, the Rig Display™ offered by Pason Systems Corp.™

The automatic driller 206 is located within a doghouse and transmits and receives analog signals. The automatic driller 206 is directly communicatively coupled to a torque sensor 218, a block height sensor 216, a hookload sensor 222, and a standpipe pressure sensor 220, which the automatic driller 206 uses to obtain torque, block height, WOB and differential pressure measurements, respectively. Each of the torque, block height, hookload and pressure sensors 218,216,222,220 sends an analog signal directly to the automatic driller 206.

The automatic driller 206 is also coupled to a brake handle controller 212 (hereinafter referred to as "brake controller 212"), which is used to control the braking force applied by band brake 207. Brake controller 212 comprises a stepper module coupled to a stepper driver which in turn is coupler to stepper motor 209. As described above, stepper motor 209 is configured to control a brake handle of the band brake 207. Moving the brake handle in a first direction decreases the braking force applied to the drum of drawworks 214, and correspondingly the travelling block 130. Conversely, moving the brake handle in a second, opposite direction increases the braking force applied to the drum of drawworks 214, and correspondingly the travelling block 130. Accordingly, control of the band brake 207 is used to adjust the velocity of the travelling block 130 of the rig, and therefore the ROP.

In other embodiments (not depicted), the automatic driller 206 may communicate with equipment via only a digital interface, only an analog interface, or communicate with a different combination of analog and digital interfaces than that shown in FIG. 2. For example, in one different embodiment (not depicted) the automatic driller 206 communicates using a digital interface to all of the sensors 216,218,220, 222.

Referring now to FIG. 3, there is shown a hardware block diagram 300 of the automatic driller 206 of FIG. 2. The automatic driller 206 comprises a microcontroller 302 communicatively coupled to a field programmable gate array ("FPGA") 320. The depicted microcontroller 302 is an ARM based microcontroller, although in different embodiments (not depicted) the microcontroller 302 may use a different architecture. The microcontroller 302 is communicatively coupled to 32 kB of non-volatile random access memory ("RAM") in the form of ferroelectric RAM 304; 16 MB of flash memory 306; a serial port 308 used for debugging purposes; LEDs 310, LCDs 312, and a keypad 314 to permit a driller to interface with the automatic driller 206; and communication ports in the form of an Ethernet port 316 and RS-422 ports 318. While FIG. 3 shows the microcontroller 302 in combination with the FPGA 320, in different embodiments (not depicted) different hardware may be used. For example, the microcontroller 302 may be used to perform the functionality of both the FPGA 320 and microcontroller 302 in FIG. 3; alternatively, a PLC may be used in place of one or both of the microcontroller 302 and the FPGA 320.

The microcontroller 302 communicates with the torque, block height, hookload and standpipe pressure sensors 218, 216,222,220 via the FPGA 320. More specifically, the FPGA 320 receives signals from these sensors 218,216,222,220 as analog inputs 322; the FPGA 320 is also able to send analog signals using analog outputs 324. These inputs 322 and outputs 324 are routed through intrinsic safety ("IS") barriers for safety purposes, and through wiring terminals 330.

The FPGA 320 is also communicatively coupled to a non-incendive depth input 332 and a non-incendive encoder input 334. In some embodiments, the FPGA 320 is communicatively coupled to a non-incendive encoder input 334 which also serves as a non-incendive depth input. In different embodiments (not depicted), the automatic driller 206 may receive different sensor readings in addition to or as an alternative to the readings obtained using the depicted sensors 216,218,220,222.

Figure 4:
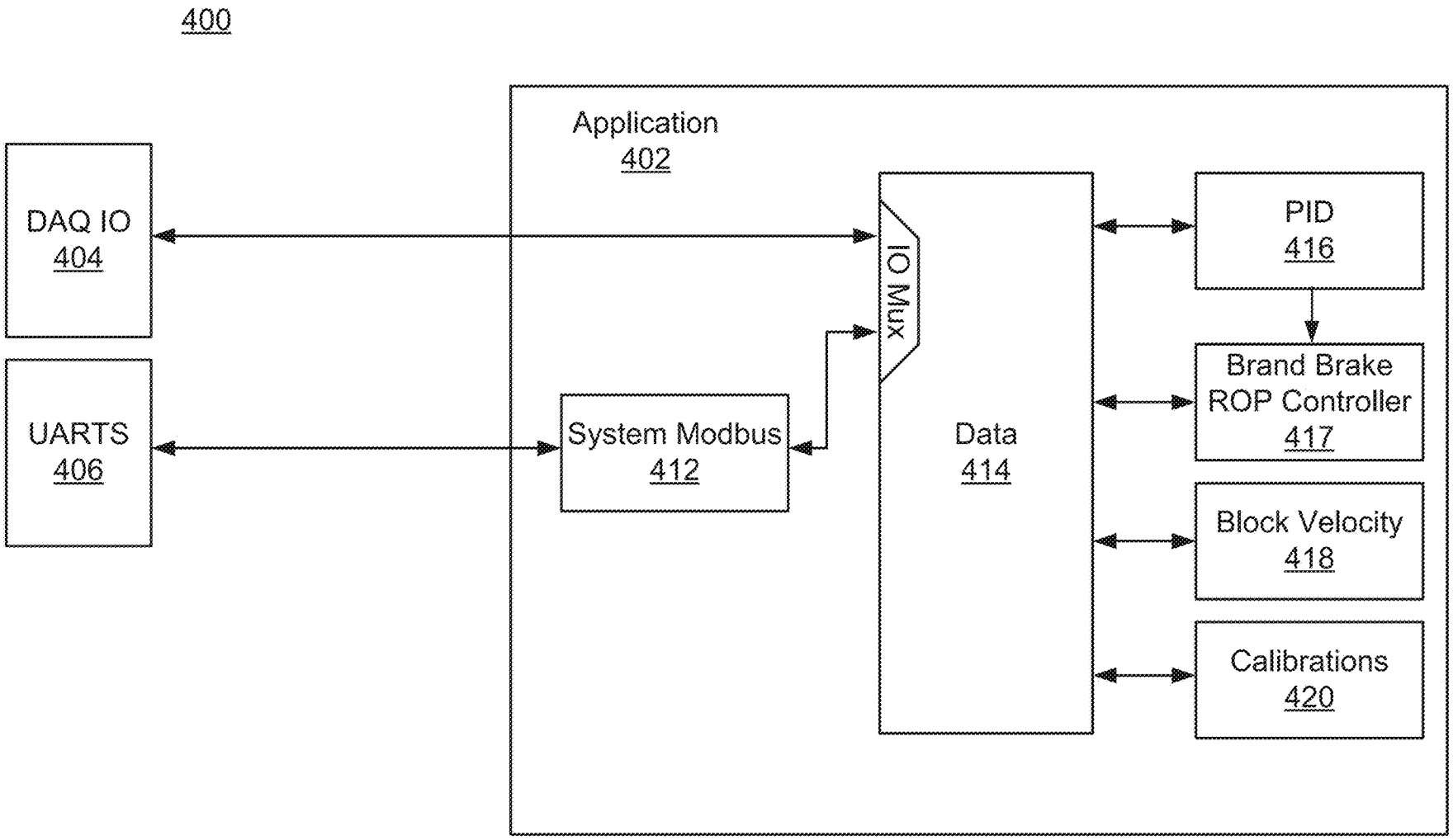
FIG. 4 depicts a block diagram of software modules running on the automatic driller of FIG. 1.

Referring now to FIG. 4, there is shown a block diagram of software modules, some of which comprise a software application 402, running on the automatic driller of FIG. 3. The application 402 comprises a data module 414 that is communicative with a PID module 416, a band brake ROP controller 417, a block velocity module 418, and a calibrations module 420. As discussed in further detail below, the microcontroller 302 runs multiple PID control loops, the output of one of which is fed into band brake ROP controller 417 for controlling the band brake 207; the microcontroller 302 does this in the PID module 416. The microcontroller 302 uses the block velocity module 418 to determine the velocity of the travelling block 130 from the travelling block height derived using measurements from the block height sensor 216. The microcontroller 302 uses the calibrations module 420 to convert the electrical signals received from the sensors 216,218,220,222 into engineering units; for example, to convert a current signal from mA into kilopounds.

The data module 414 also communicates using an input/output multiplexer, labeled "IO Mux" in FIG. 4. In one of the multiplexer states the data module 414 communicates digitally via the Modbus protocol using the system modbus 412 module, which is communicative with the UARTS 406. In another of the multiplexer states, the data module 414 communicates analog data directly using the data acquisition in/out module 404.

Figure 5:
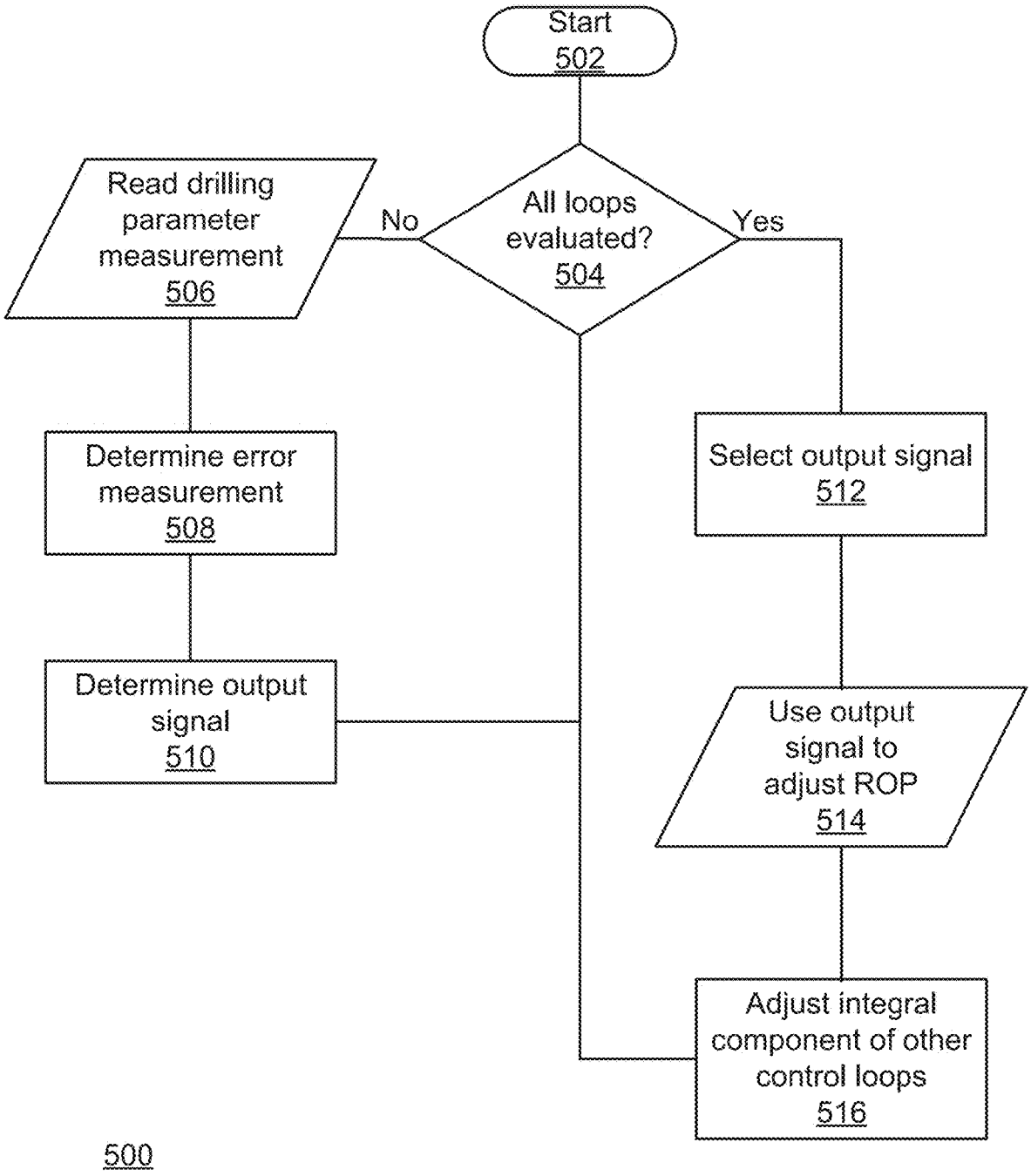
FIG. 5 depicts a method for controlling the rate of penetration of a drill bit, according to another example embodiment.

Referring now to FIG. 5, there is shown a method 500 for controlling the rate of penetration of a drill bit, according to another example embodiment. The method 500 may be encoded as computer program code and stored on to the flash memory 306. The computer program code is executable by the microcontroller 302 and, when executed by the microcontroller 302, causes the microcontroller 302 and consequently the automatic driller 206 to perform the method 500 of FIG. 5.

In FIG. 5, the microcontroller 302 receives a reading from the hookload sensor 222 from which it determines a WOB measurement; a reading from the standpipe pressure sensor 220 from which it determines a differential pressure (i.e., a pressure difference between the standpipe pressure and the standpipe pressure as measured when the drill bit 112 is off bottom) measurement; and a reading from the torque sensor 218 from which it determines a torque measurement of torque applied to the drill string 110 by the top drive 128 or in one different embodiment a rotary table. As discussed in further detail below, by performing the method 500 the microcontroller 302 is able to keep all of WOB, torque, and differential pressure substantially at or below a desired setpoint. In the depicted embodiment, the microcontroller 302 operates three PID control loops (each a "control loop") using the PID module 416. Each of the control loops receives as input one of the drilling parameter measurements (e.g., the WOB measurement, the differential pressure measurement, and the torque measurement) and outputs a signal to band brake ROP controller 417. The output of band brake ROP controller 417 is used to command brake controller 212 to adjust the rate of penetration of the drill string 110, by adjusting a position of a brake handle. In the depicted embodiment, the output signal for any one of the control loops comprises the sum of a proportional component, an integral component, and a derivative component. The proportional component comprises the product of a proportional gain and an error measurement that represents a difference between a drilling parameter setpoint and the drilling parameter measurement; the integral component comprises the product of an integral gain and the sum of previous error measurements; and the derivative component comprises the product of a derivative gain and the rate of change of the error measurement. While in the depicted embodiment the control loops use all of the proportional, integral, and derivative components, in different embodiments (not depicted), any one or more of the control loops may comprise only the proportional and integral components, or be of a non-PI or PID type.

In the method 500 of FIG. 5, the microcontroller 302 evaluates each of the control loops once and in sequence for each of the drilling parameters before deciding whether to adjust the output signal sent to band brake ROP controller 417. Accordingly, the microcontroller 302 at block 504 determines if, for a particular iteration of the method 500, the control loops corresponding to each of WOB, differential pressure, and torque have been evaluated. If not, the microcontroller 302 proceeds to block 506 where it begins to evaluate one of the control loops.

At block 506, the microcontroller 302 obtains a drilling parameter measurement of the drilling parameter associated with the control loop being evaluated. For example, if the microcontroller 302 is evaluating the control loop for WOB, the microcontroller 302 reads the hookload sensor 222 and from it determines the WOB measurement. After reading the drilling parameter measurement at block 506, the microcontroller 302 proceeds to block 508 where it determines an error measurement that represents a difference between a drilling parameter setpoint and the drilling parameter measurement. After determining the error measurement, the microcontroller 302 evaluates the control loop to determine the control loop's output signal. The microcontroller 302 does this by evaluating Equation (1):

$$\text{Output Signal} = K_p e(t) + K_i \int_0^t e(\tau)d\tau + K_d \frac{de(t)}{dt} \quad (1)$$

Equation (1) is an equation for evaluating a PID control loop in a continuous time domain; alternatively, the microcontroller 302 may evaluate any one or more of the control loops, or any one or more terms of any one or more of the control loops, in the discrete time domain.

Once the microcontroller 302 determines the output signal for the control loop at block 510, it returns to block 504. If any control loops remain unevaluated for the current iteration of the method 500, the microcontroller 302 performs blocks 506, 508, and 510 again to evaluate one of the unevaluated control loops. If the microcontroller 302 has evaluated all of the control loops for the current iteration of the method 500, the microcontroller 302 proceeds to block 512.

In FIG. 5, for any particular iteration of the method 500, the microcontroller 302 evaluates each of the control loops once and in sequence. In different embodiments (not depicted), however, the microcontroller 302 may evaluate the control loops differently. For example, the microcontroller 302 may evaluate any one or more of the control loops in parallel before proceeding to block 512. Additionally or alternatively, the microcontroller 302 may evaluate any one or more of the control loops in a separate thread and rely on interrupts to determine when to perform blocks 512 to 516.

When the microcontroller 302 arrives at block 512, it selects which of the control loops to use to control the rate of penetration of the drill bit 112. In the depicted embodiment, the microcontroller 302 does this by sending the output signal of the lowest magnitude to the band brake ROP controller 417 that then, as described in further detail below, relays its output signal to the brake controller 212. The brake controller 212 in turn adjusts the position of the band brake handle to vary the braking force applied to the drum of drawworks 214, as a function of the signal received from band brake ROP controller 417. In particular, the output signal of the selected control loop is received by band brake ROP controller 417 which in response sends a brake handle movement signal to brake controller 212. Thus, ROP may be controlled by using the acceleration of travelling block 130 as a controlling parameter. The output signal is used to define a travelling block velocity setpoint, i.e. a target travelling block velocity. As mentioned above, velocity of the travelling block 130 and ROP may be used interchangeably as they are directly proportional to one another, and therefore the output signal may be used to define an ROP setpoint, i.e. a target ROP. In the depicted embodiment, the output signal may vary, for example, between 0% and 100% throttle, with 0% throttle corresponding to a rate of penetration of 0 m/hr and 100% throttle corresponding to a rate of penetration of 400 to 500 m/hr. Throttle refers to an ROP target for the band brake ROP controller 417.

As described above, the microcontroller 302 selects the output signal of lowest magnitude to control the rate of penetration. If the throttle (ROP target) is higher than the user-entered ROP setpoint, then the user-entered ROP setpoint is selected as the ROP target. However, in different embodiments the microcontroller 302 may select the output signal by applying a different rule or set of rules. For example, in one different embodiment the microcontroller 302 determines which of the control loops has the error measurement that is the lowest percentage error relative to the drilling parameter setpoint for that control loop, and then uses the output signal for that control loop to control the rate of penetration. In another different embodiment, a combination of multiple selection methods may be used to select the output signal that is used.

The microcontroller 302 subsequently proceeds to block 516 where it adjusts the integral component of the output signals of the control loops that are not used to adjust the drill string's 110 ROP so that those output signals are approximately, and in certain embodiments exactly, equal to the output signal of lowest magnitude used to adjust the ROP. For example, if the output of the WOB control loop is the lowest of the outputs of the control loops and is sent to the band brake ROP controller 417 at block 514, at block 516 the microcontroller 302 adjusts the integral component of each of the differential pressure and torque control loops such that their outputs equals the output of the WOB control loop. In certain embodiments, the integral component may be negative to account for a relatively high proportional component, derivative component, or both. Adjusting the integral component in this fashion facilitates a relatively continuous transfer of control from one control loop to another.

Now turning to FIGS. 6-9, there are shown a state diagram and various flow diagrams representing example embodiments of how band brake ROP controller 417 controls ROP based on the output of PID 416. Some of the blocks illustrated in the flow diagrams may be performed in an order other than that which is described. Also, it should be appreciated that not all of the blocks described in the flow diagrams are required to be performed, that additional blocks may be added, and that some of the illustrated blocks may be substituted with other blocks.

Figure 6:
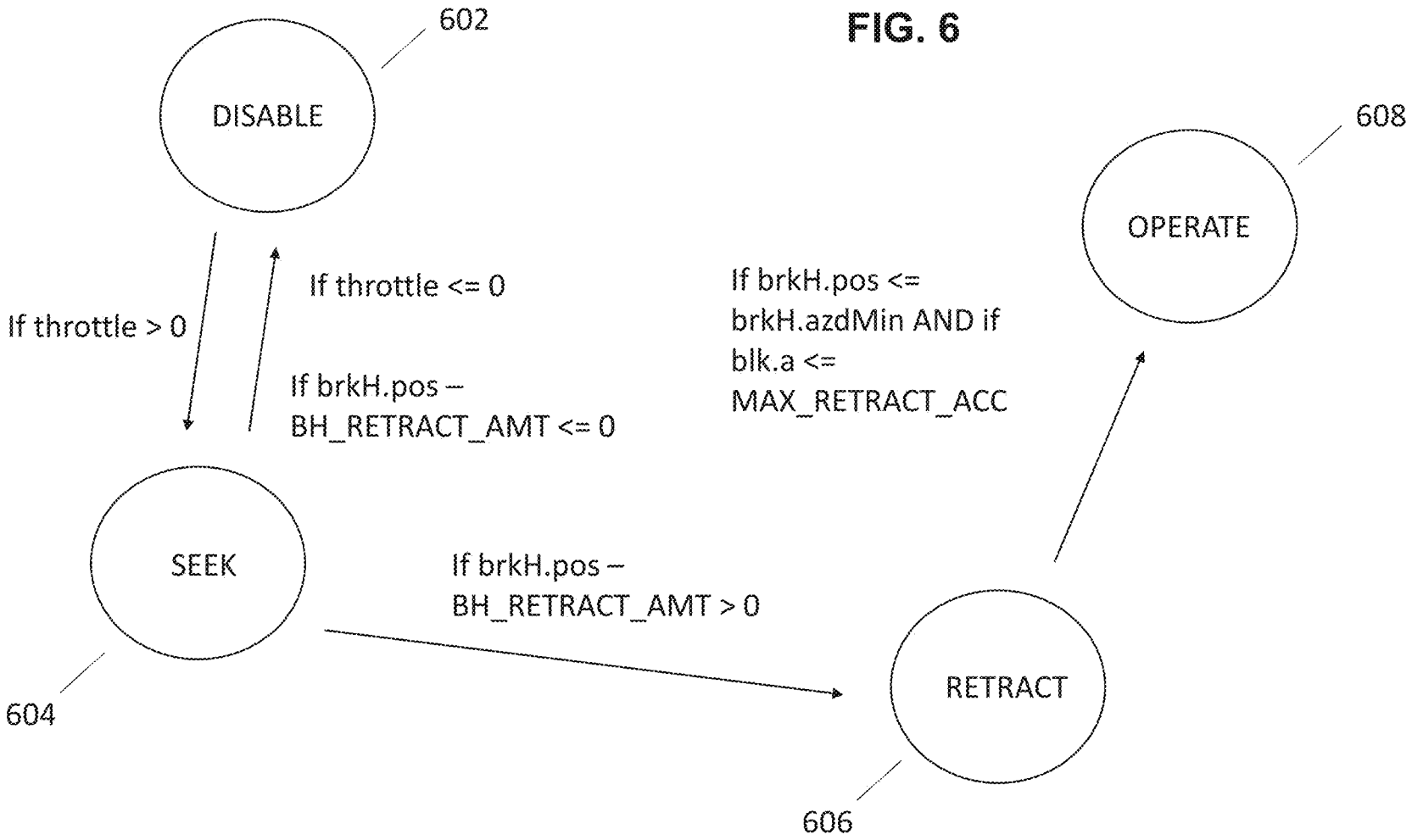
FIG. 6 depicts a state diagram for a brake controller, according to another example embodiment.

FIG. 6 shows a state diagram representing four different states of band brake ROP controller 417: a disable state 602, a seek state 604, a retract state 606, and an operate state 608.

When in disable state 602, the brake handle is set to a position in which a maximum braking force is applied to travelling block 130 such that travelling block 130 does not move. If band brake ROP controller 417 determines that throttle >0, then band brake ROP controller 417 transitions to seek state 604. As described in further detail below, in seek state 604 band brake ROP controller 417 identifies, by commanding brake controller 212 to rapidly move the brake handle in a first direction to reduce the braking force, a position of the brake handle corresponding to which movement of travelling block 130 is first detected. Movement of travelling block 130 is detected when feedback from the block position sensor 216 is received. Once movement of travelling block 130 is detected, band brake ROP controller 417 transitions to retract state 606 in which the brake handle is moved in a second, opposite direction in order to reapply the braking force until acceleration of the travelling block 130 drops below a threshold and a preset minimum retraction (BH_RETRACT_AMT) of the brake handle is achieved. The positions of the brake handle at which movement of travelling block 130 is detected and at which movement of travelling block 130 is slowed sufficiently represent, respectively, lower and upper braking force limits. In particular, the lower braking force limit corresponds to the braking force applied by band brake 207 when movement of travelling block 130 is first detected, and the upper braking force limit corresponds to the braking force applied by band brake 207 when travelling block 130 has slowed sufficiently.

These limits define a dynamic operating range within which the band brake 207 is operated. Operating the band brake 207 between the lower and upper braking force limits, i.e. moving the brake handle between the end positions identified in the seek and retract states, may be advantageous as it produces a smoother variation in ROP. In what follows, brake handle position is used synonymously with braking force, on the understanding that a certain position of the brake handle causes a corresponding braking force to be applied to travelling block 130. Of course, different braking mechanisms may produce different braking forces as a function of brake handle position. Therefore, as described herein, the seek and retract states are used to identify the initial endpoints of the dynamic range within which the brake handle will be moved, i.e. the lower and upper braking force limits which will be applied to travelling block 130.

In seek state 604, if throttle <=0 or if a position of the brake handle is less than or equal to BH_RETRACT_AMT, then brake ROP controller 417 transitions back to disable state 602. In retract state 606, if brake ROP controller 417 determines that the current braking force is greater than or equal to the upper braking force limit (brkH.azdMin), and if a current acceleration (blk.a) of travelling block 130 is less than or equal to a preset maximum acceleration (MAX_RETRACT_ACC), then brake ROP controller 417 transitions to operate state 608.

Figure 7:
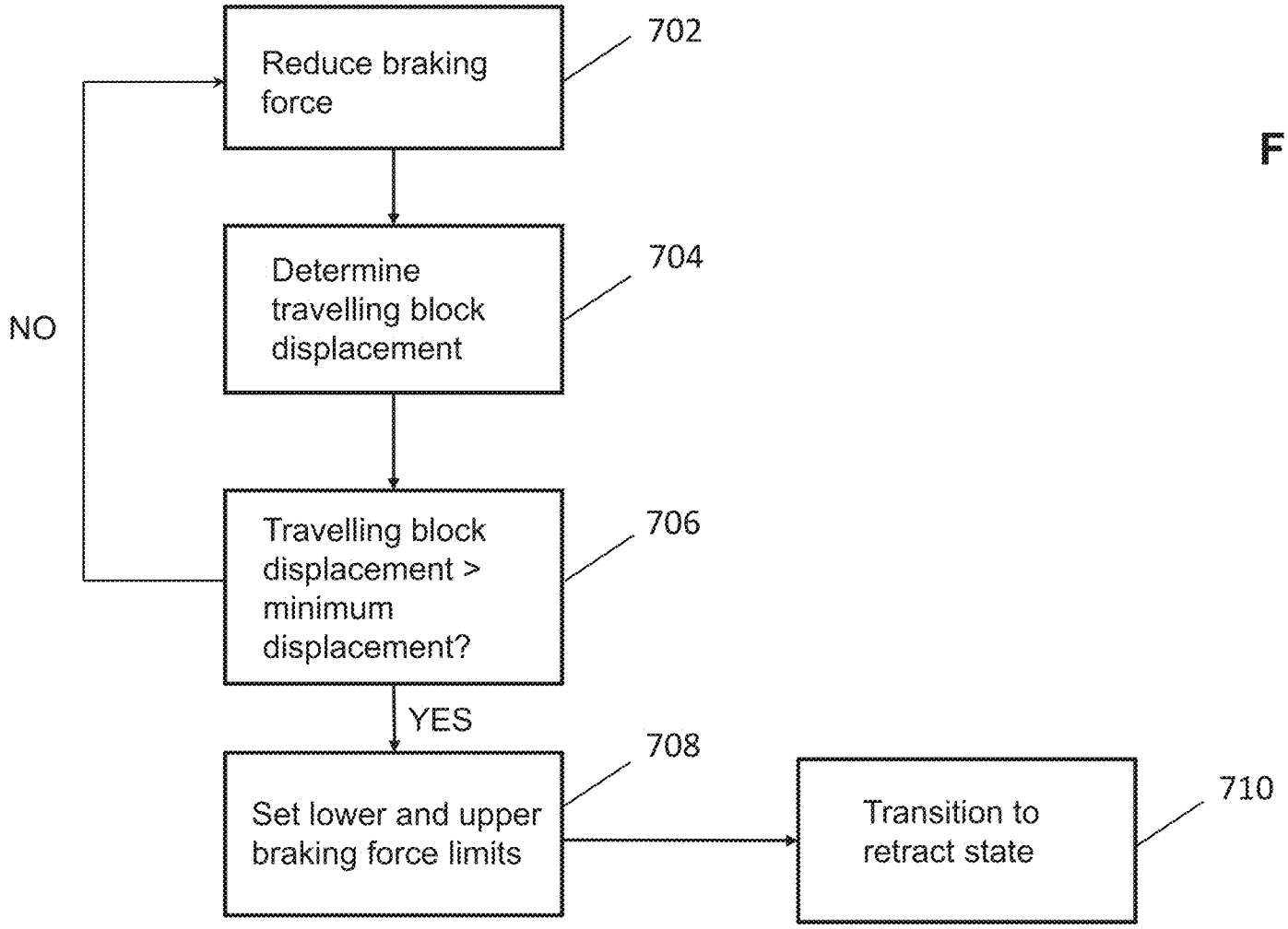
FIG. 7 is a flow diagram for a seek state of the brake controller, according to another example embodiment.
Figure 8:
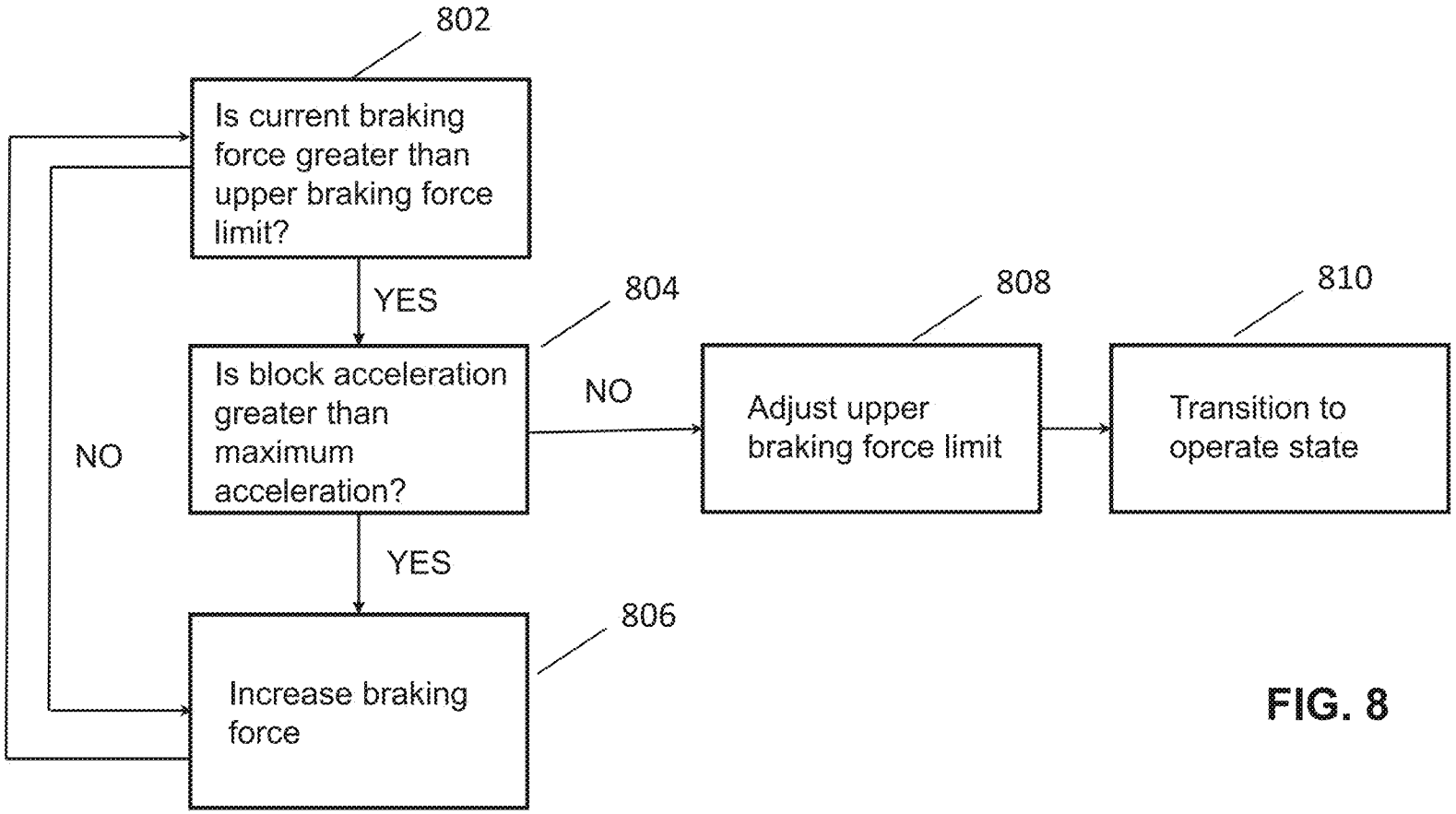
FIG. 8 is a flow diagram for a retract state of the brake controller, according to another example embodiment.
Figure 9:
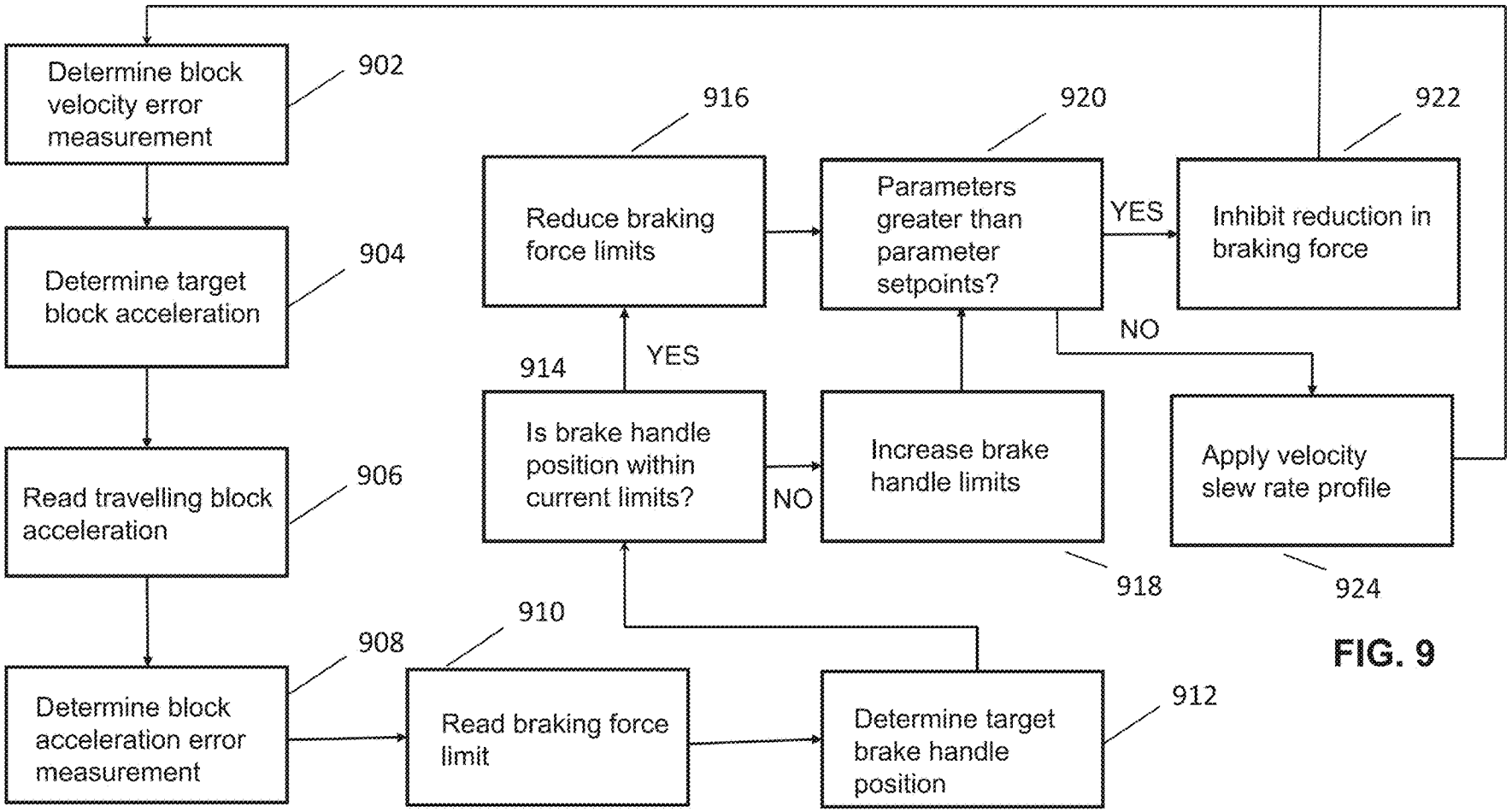
FIG. 9 is a flow diagram for an operate state of the brake controller, according to another example embodiment.

FIGS. 7-9 illustrate the seek, retract and operate states 604, 606, 608 in more detail. Referring to FIG. 7, in the seek state 604, brake ROP controller 417 identifies the lower braking force limit at which the band brake 207 will operate. At block 702, brake ROP controller 417 commands brake controller 212 to pull forward on the brake handle to release some of the braking force applied to travelling block 130. At block 704, brake ROP controller 417 determines via the block height sensor 216 whether a position of travelling block 130 has changed (i.e. brake ROP controller 417 determines a displacement of travelling block 130). At block 706, brake ROP controller 417 determines whether the travelling block displacement is greater than a preset minimum travelling block displacement. If the travelling block displacement is not greater than the preset minimum travelling block displacement, the process returns to block 702, and blocks 702, 704 and 706 are repeated until the travelling block displacement is determined to be greater than the preset minimum travelling block displacement, i.e. once sufficient movement of travelling block 130 is detected. At block 708, brake ROP controller 417 commands brake controller 212 to release the brake handle to reapply a relatively large amount of braking force to travelling block 130 (corresponding to the preset change in brake handle position, BH_RETRACT_AMT, mentioned above). At block 710, the lower and upper braking force limits are set by brake ROP controller 417. As described above, the lower braking force limit corresponds to the position of the brake handle at which sufficient movement of the travelling block 130 was detected (block 706). The upper braking force limit corresponds to the position of the brake handle following reapplication of the preset amount of braking force (i.e. following retraction of the brake handle by the present amount BH_RETRACT_AMT).

Turning to FIG. 8, in the retract state 606, brake ROP controller 417 commands brake controller 212 to release quickly on the brake handle so as to further reapply the braking force to travelling block 130 until travelling block 130 is sufficiently slowed. In particular, at block 802, brake ROP controller 417 determines whether the current braking force applied by band brake 207 is greater than upper braking force limit. If the current braking force applied by band brake 207 is less than the upper braking force limit, the process moves to block 806 (see below). If the current braking force is greater than the upper braking force limit, then at block 804 brake ROP controller 417 determines whether a current acceleration of travelling block 130 is greater than a maximum allowable acceleration of travelling block 130. If so, then at block 806 brake ROP controller 417 commands brake controller 212 to move the brake handle so as to increase the braking force toward the upper braking force limit, and the process returns to block 802. If the current braking force is greater than the upper braking force limit, and if a current acceleration of travelling block 130 is less than the maximum allowable acceleration of travelling block 130 (i.e. movement of travelling block 130 is deemed to have slowed sufficiently), then at block 808 the upper braking force limit is adjusted by setting it equal to the current braking force corresponding to the current brake handle position, and at block 810 brake ROP controller 417 transitions to operate state 608. With the seek and retract states having been completed, brake ROP controller 417 has now determined the operational range within which the brake handle may be moved. As will be seen below, the lower and upper braking force limits are not fixed but rather are dynamically adjusted as a function of a target brake handle position that brake ROP controller 417 continuously pursues in order to control ROP.

Turning to FIG. 9, in the operate state 608, there is shown a process with which brake ROP controller 417 aims to control ROP by using acceleration of the travelling block 130 as a controlling parameter. At block 902, brake ROP controller 417 determines a travelling block velocity error measurement. The travelling block velocity error measurement is a function of the measured velocity of the travelling block 130 and a travelling block velocity setpoint. The travelling block velocity setpoint is determined by the output signal of the selected PID loop (FIG. 5). At block 904, brake ROP controller 417 determines a target travelling block acceleration. The target travelling block acceleration is a function of the block velocity error measurement and a preset conversion factor. At block 906, brake ROP controller 417 reads an acceleration of the travelling block 130. The travelling block acceleration may be determined by time indexing the travelling block velocity measurements and dividing changes in the block velocity measurements over time. At block 908, brake ROP controller 417 determines a travelling block acceleration error measurement. The acceleration error measurement is determined by comparing the target travelling block acceleration with the measured travelling block acceleration. At block 910, brake ROP controller 417 determines the current braking force limit. For example, if the acceleration error measurement is a positive value, brake ROP controller 417 may read the lower braking force limit, and if the acceleration error measurement is negative then brake ROP controller 417 may read the upper braking force limit. At block 912, brake ROP controller 417 determines a target brake handle position.

The target brake handle position is the target position of the brake handle to which the brake handle will be moved and at which band brake 207 will apply a target braking force. The target position of the brake handle is a function of the travelling block acceleration error measurement and the braking force limit (lower or upper) determined at blocks 908 and 910. At block 914, brake ROP controller 417 determines if the current position of the brake handle is between the current lower and upper braking force limits. If so, then at block 916 one or more of the lower and upper braking force limits are reduced. If the current position of the brake handle is outside of the operating range defined by the lower and upper braking force limits, then at block 918 brake ROP controller 417 sets the braking force limit in effect (as determined at block 910) to the current brake handle position. In other words, the braking force limit is adjusted so as to correspond to a braking force applied by the current brake handle position. Therefore, if the brake handle is moved outside of the operating range, the operating range is redefined by setting one of the limits to correspond to the current brake handle position.

Figure 10A:
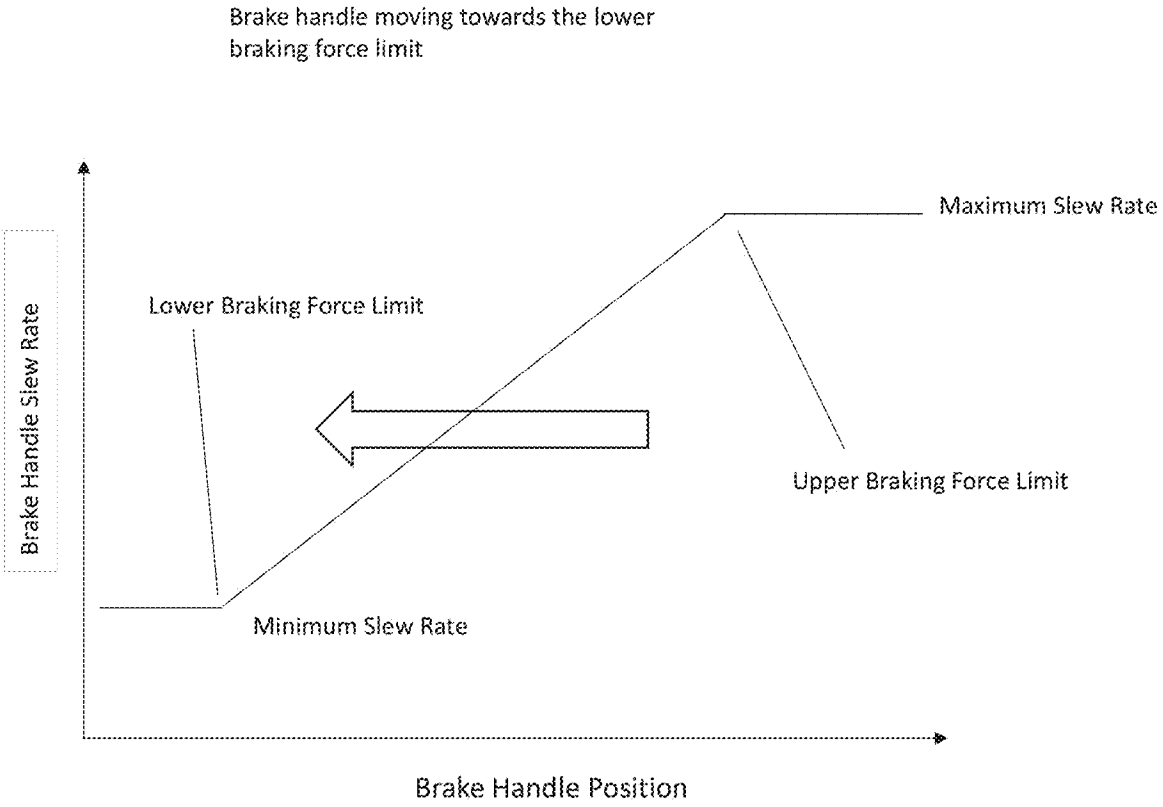
FIGS. 10A and 10B are plots of brake handle slew rate as a function of brake handle position.
Figure 10B:
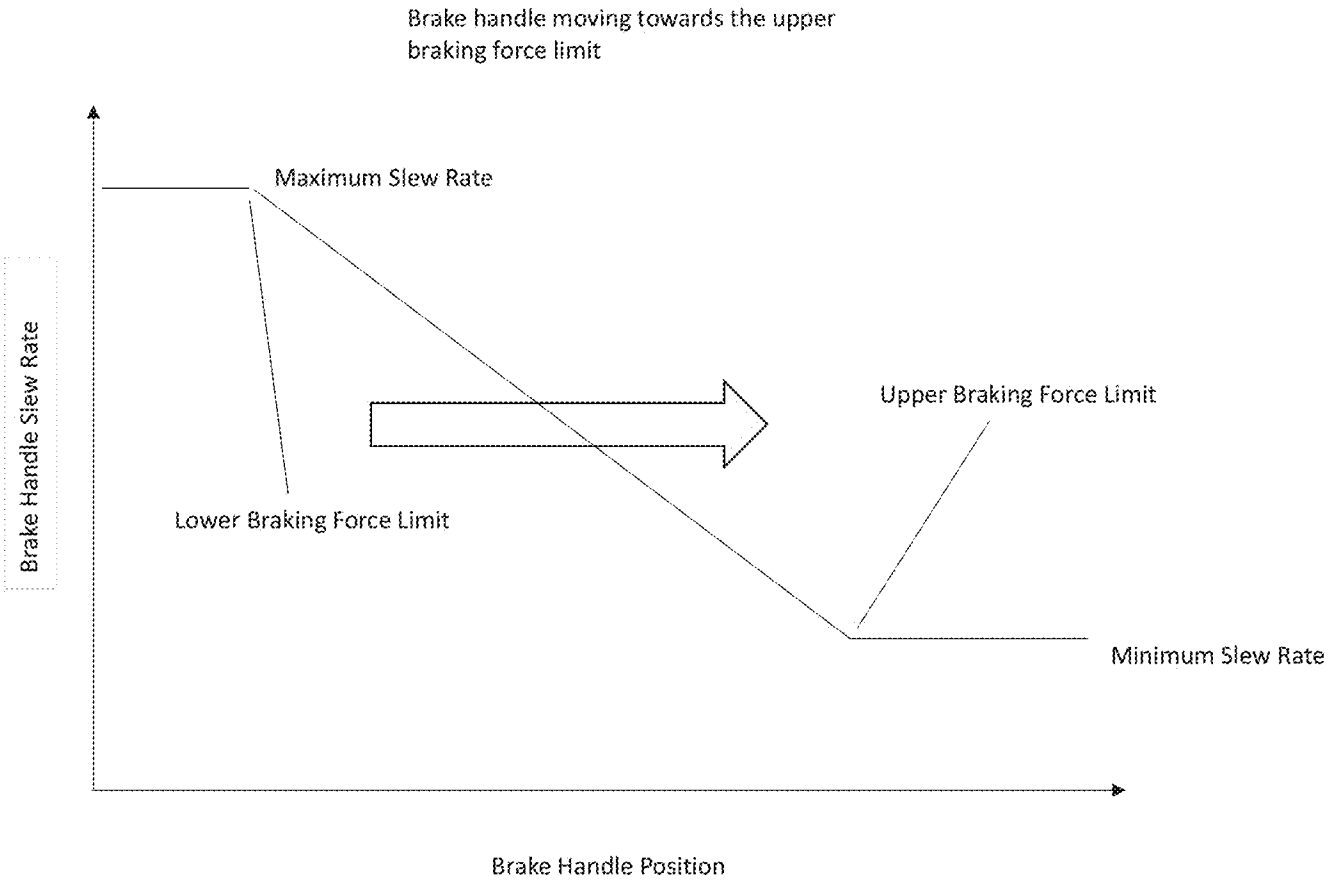

At block 920, brake ROP controller 417 determines whether any of the WOB, torque, and differential pressure setpoints plus a predetermined offset is less than a current reading of WOB, torque and differential pressure. In other words, brake ROP controller 417 determines whether the current WOB, torque or differential pressure has exceeded its current setpoint plus a predetermined offset. If so, then at block 922 brake ROP controller 417 inhibits further reduction in the braking force, and the process then returns to block 902. If not, then at block 924 brake ROP controller 417 commands brake controller 212 to adjust the position of the brake handle toward the target brake handle position. The rate at which the brake handle position is adjusted is a function of the current direction in which the brake handle is being moved. In particular, adjustment of the brake handle position is accelerated if the brake handle position is being moved from the lower braking force limit to the upper braking force limit. Conversely, adjustment of the brake handle position is decelerated if the brake handle position is being moved from the upper braking force limit to the lower braking force limit. FIGS. 10A and 10B illustrate exemplary rates of adjustment ("slew rates") of the brake handle position as a function of the current brake handle position. After adjustment of the brake handle position, the process moves back to block 924 where the operate loop 608 is repeated.

Figure 11A:
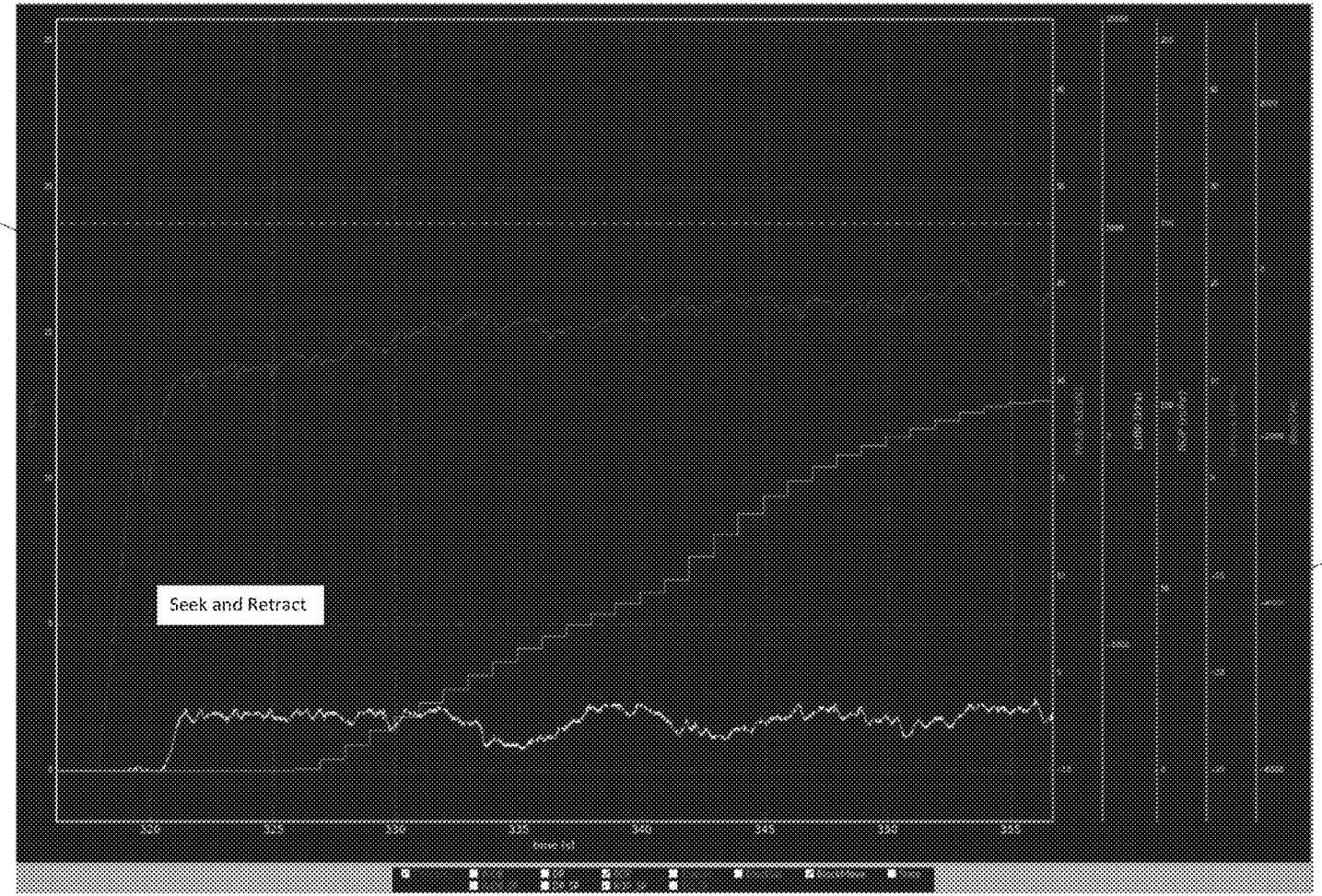
FIGS. 11A and 11B are plots of rate of penetration and brake handle position as a function of time, according to another example embodiment.
Figure 11B:
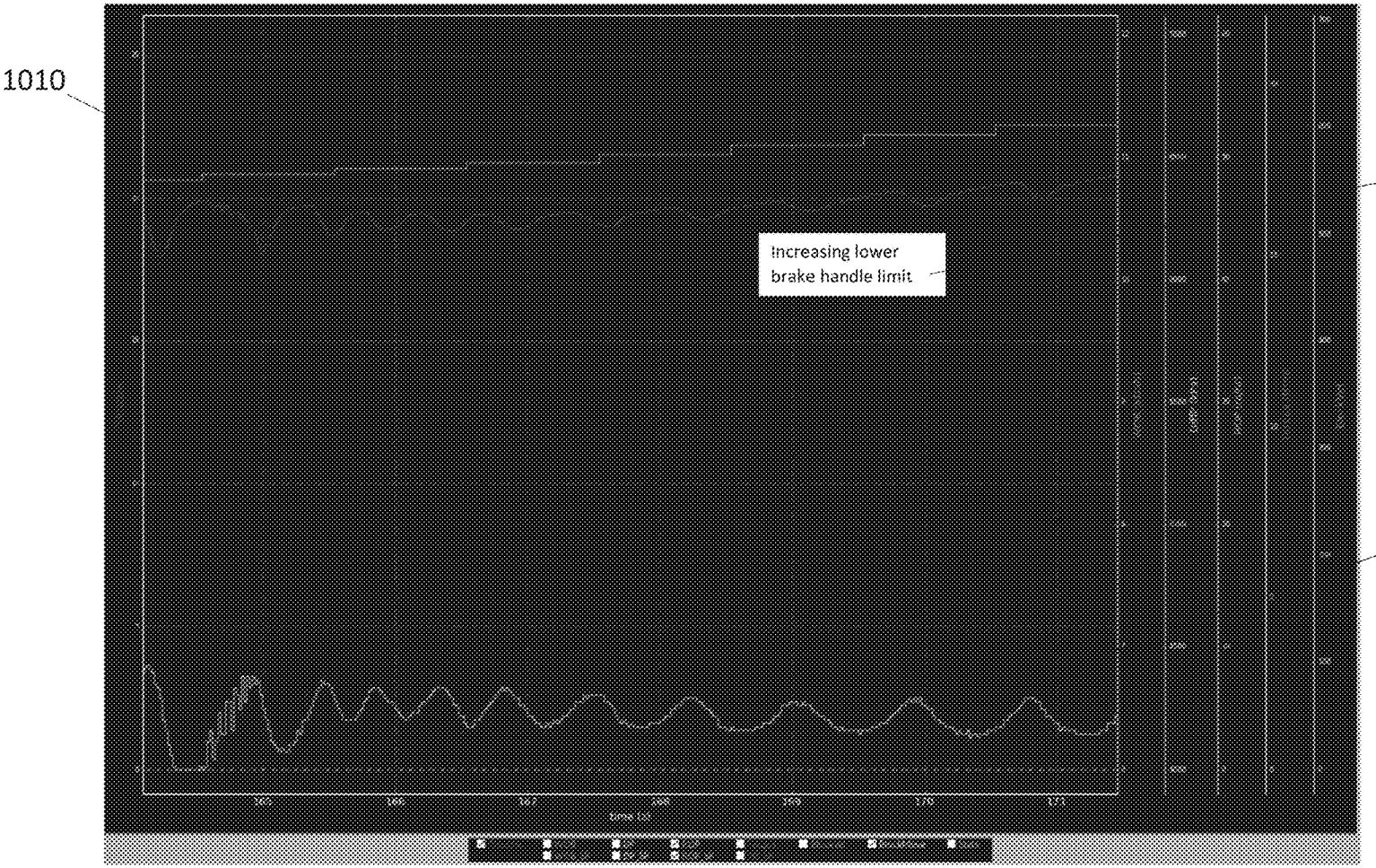

FIGS. 11A and 11B are plots of brake handle position 1010 and ROP 1020 as a function of time. "Throttle" on the y-axis corresponds to the position of the brake handle (which, as explained above, is a proxy for the amount of braking force applied to travelling block 130). On the left-hand side of the graph can be seen a sharp increase in throttle corresponding to the seek state, and a subsequent decrease corresponding to the retract state. The "BlockMove" plot at the bottom of the graph is a high-speed indication of ROP.

In the plot of FIG. 11B, the position of the brake handle can be seen to oscillate between the lower and upper braking force limits. In the region 1030, the lower braking force limit can be seen to increase as the brake handle position is moved past the lower braking force limit.

FIGS. 5 and 7-9 are flow diagrams of an example embodiment of a method. Some of the blocks illustrated in the flowcharts may be performed in an order other than that which is described. Also, it should be appreciated that not all of the blocks described in the flowchart are required to be performed, that additional blocks may be added, and that some of the illustrated blocks may be substituted with other blocks.

While the microcontroller 302 is used in the foregoing embodiments, in different embodiments (not depicted) the microcontroller 302 may instead be, for example, a microprocessor, processor, controller, programmable logic controller, field programmable gate array, or an application-specific integrated circuit. Examples of computer readable media are non-transitory and include disc-based media such as CD-ROMs and DVDs, magnetic media such as hard drives and other forms of magnetic disk storage, and semiconductor based media such as flash media, SSDs, random access memory, and read only memory. Additionally, for the sake of convenience, the example embodiments above are described as various interconnected functional blocks. This is not necessary, however, and there may be cases where these functional blocks are equivalently aggregated into a single logic device, program or operation with unclear boundaries. In any event, the functional blocks can be implemented by themselves, or in combination with other pieces of hardware or software.

As used herein, the terms "approximately" and "about" when used in conjunction with a value mean+/−20% of that value.

Directional terms such as "top", "bottom", "upwards", "downwards", "vertically", and "laterally" are used in this disclosure for the purpose of providing relative reference only, and are not intended to suggest any limitations on how any article is to be positioned during use, or to be mounted in an assembly or relative to an environment. Additionally, the term "couple" and variants of it such as "coupled", "couples", and "coupling" as used in this disclosure are intended to include indirect and direct connections unless otherwise indicated. For example, if a first article is coupled to a second article, that coupling may be through a direct connection or through an indirect connection via another article. As another example, when two articles are "communicatively coupled" to each other, they may communicate with each other directly or indirectly via another article. Furthermore, the singular forms "a", "an", and "the" as used in this disclosure are intended to include the plural forms as well, unless the context clearly indicates otherwise.

While the methods and systems described herein have been discussed in the context of a band brake, it is to be understood that any suitable braking mechanism (such as a disc brake) may be employed, provided that the braking mechanism may apply a variable braking force to the travelling block.

Persons skilled in the art will therefore readily appreciate that, while the disclosure discusses adjusting the position of a brake handle, this is in context of adjusting a braking force that is applied to the travelling block. With this in mind, it will be recognized by persons of skill in the art that the disclosure extends to braking mechanisms in which no braking handle is used. For instance, the disclosure could extend to controlling a braking mechanism which uses non-mechanical means of applying a braking force. Therefore, the disclosure extends to any method of controlling, directly or indirectly, the variable braking force applied by the braking mechanism, irrespective of how the braking force is varied.

It is contemplated that any part of any aspect or embodiment discussed in this specification can be implemented or combined with any part of any other aspect or embodiment discussed in this specification.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A method for controlling rate of penetration of a drill bit, the method comprising:

evaluating an operate control loop by:

determining a travelling block acceleration of a travelling block;

determining an acceleration error measurement between the travelling block acceleration and a target travelling block acceleration; and determining, based on the acceleration error measurement, a brake control signal;

using the brake control signal to control a braking mechanism configured to apply a variable braking force to the travelling block, wherein using the brake control signal to control the braking mechanism comprises using the travelling block acceleration as a controlling parameter for controlling the braking mechanism so as to control the rate of penetration of the drill bit;

controlling the rate of penetration of the drill bit based on the variable braking force applied by the braking mechanism; and prior to evaluating the operate control loop:

performing a seek operation by:

controlling the braking mechanism so as to reduce the variable braking force; and in response to reducing the variable braking force, detecting a minimum amount of movement of the travelling block; and subsequent to performing the seek operation, performing a retract operation by:

further controlling the braking mechanism so as to increase the variable braking force; and in response to increasing the variable braking force, detecting that an amount of movement of the travelling block is less than a maximum amount of movement of the travelling block.

2. The method of claim 1, wherein the operate control loop is further evaluated by:

reading a travelling block velocity of the travelling block;

determining, based on the travelling block velocity, a velocity error measurement between the travelling block velocity and a travelling block velocity setpoint; and determining, based on the velocity error measurement, the target travelling block acceleration.

3. The method of claim 1, wherein the braking mechanism is configured to operate within an operating range defined by a lower braking force limit at which the braking mechanism applies a lower braking force, and an upper braking force limit at which the braking mechanism applies an upper braking force greater than the lower braking force.

4. The method of claim 1, wherein, in the seek operation, the amount of movement comprises a displacement of the travelling block, and wherein, in the retract operation, the amount of movement comprises an acceleration of the travelling block.

5. The method of claim 3, wherein the operate control loop is further evaluated by:

determining that a current braking force applied by the braking mechanism is lower than the lower braking force limit, and, in response to determining that the current braking force applied by the braking mechanism is lower than the lower braking force limit, reducing the lower braking force limit; or determining that a current braking force applied by the braking mechanism is greater than the upper braking force limit, and, in response to determining that the current braking force applied by the braking mechanism is greater than the upper braking force limit, increasing the upper braking force limit.

6. The method of claim 1, wherein the operate control loop is further evaluated by, in response to determining that a travelling block velocity of the travelling block is greater than a preset maximum velocity, controlling the braking mechanism so as to apply a maximum braking force to the travelling block.

7. The method of claim 1, further comprising, prior to evaluating the operate control loop, for each of multiple drilling parameters, evaluating a control loop by:

reading a drilling parameter measurement;

determining an error measurement that represents a difference between a drilling parameter setpoint and the drilling parameter measurement; and determining, from the error measurement, an output signal proportional to the rate of penetration of the drill bit; and selecting the output signal of one of the control loops; and using the output signal that is selected to determine the travelling block velocity setpoint.

8. A system for controlling rate of penetration of a drill bit, the system comprising:

a braking mechanism configured to apply a variable braking force to a travelling block;

a processor;

a computer-readable medium communicatively coupled to the processor and having stored thereon computer program code configured when executed by the processor to cause the processor to perform a method comprising:

evaluating an operate control loop by:

determining a travelling block acceleration of the travelling block;

determining an acceleration error measurement between the travelling block acceleration and a target travelling block acceleration; and determining, based on the acceleration error measurement, a brake control signal;

using the brake control signal to control the braking mechanism, wherein using the brake control signal to control the braking mechanism comprises using the travelling block acceleration as a controlling parameter for controlling the braking mechanism so as to control the rate of penetration of the drill bit;

controlling the rate of penetration of the drill bit based on the variable braking force applied by the braking mechanism; and prior to evaluating the operate control loop:

performing a seek operation by:

controlling the braking mechanism so as to reduce the variable braking force; and in response to reducing the variable braking force, detecting a minimum amount of movement of the travelling block; and subsequent to performing the seek operation, performing a retract operation by:

further controlling the braking mechanism so as to increase the variable braking force; and in response to increasing the variable braking force, detecting that an amount of movement of the travelling block is less than a maximum amount of movement of the travelling block.

9. The system of claim 8, wherein the operate control loop is further evaluated by:

reading a travelling block velocity of the travelling block;

determining, based on the travelling block velocity, a velocity error measurement between the travelling block velocity and a travelling block velocity setpoint; and determining, based on the velocity error measurement, the target travelling block acceleration.

10. The system of claim 8, wherein the braking mechanism is configured to operate within an operating range defined by a lower braking force limit at which the braking mechanism applies a lower braking force, and an upper braking force limit at which the braking mechanism applies an upper braking force greater than the lower braking force.

11. The system of claim 8, wherein:

controlling the braking mechanism so as to reduce the variable braking force comprises transitioning the braking mechanism from a maximum braking force limit, at which the braking mechanism applies a maximum braking force, to a first braking force limit at which the braking mechanism applies a first braking force; and controlling the braking mechanism so as to increase the variable braking force comprises transitioning the braking mechanism from the first braking force limit to a second braking force limit at which the braking mechanism applies a second braking force greater than the first braking force and less than the maximum braking force.

12. The system of claim 8, wherein, in the seek operation, the amount of movement comprises a displacement of the travelling block, and wherein, in the retract operation, the amount of movement comprises an acceleration of the travelling block.

13. The system of claim 10, wherein the operate control loop is further evaluated by:

determining that a current braking force applied by the braking mechanism is lower than the lower braking force limit, and, in response to determining that the current braking force applied by the braking mechanism is lower than the lower braking force limit, reducing the lower braking force limit; or determining that a current braking force applied by the braking mechanism is greater than the upper braking force limit, and, in response to determining that the current braking force applied by the braking mechanism is greater than the upper braking force limit, increasing the upper braking force limit.

14. The system of claim 8, wherein controlling the variable braking force comprises controlling a rate at which the variable braking force is adjusted as a function of the current braking force applied by the braking mechanism.

15. The system of claim 8, wherein the braking mechanism comprises a band brake or a disc brake.

16. The system of claim 8, wherein controlling the braking mechanism comprises controlling a position of a brake handle operably connected to the braking mechanism.

17. The system of claim 8, wherein the method further comprises, prior to evaluating the operate control loop, for each of multiple drilling parameters, evaluating a control loop by:

reading a drilling parameter measurement;

determining an error measurement that represents a difference between a drilling parameter setpoint and the drilling parameter measurement; and determining, from the error measurement, an output signal proportional to the rate of penetration of the drill bit; and selecting the output signal of one of the control loops; and using the output signal that is selected to determine the travelling block velocity setpoint.

18. A non-transitory computer-readable medium communicatively coupled to a processor and storing computer program code configured when executed by the processor to cause the processor to perform a method according to claim 1.

19. The system of claim 8, wherein the braking mechanism is controlled by a stepper motor.

* * * * *